US010254699B2

(12) United States Patent
Kanno et al.

(10) Patent No.: US 10,254,699 B2
(45) Date of Patent: Apr. 9, 2019

(54) IMAGE FORMING APPARATUS TO CORRECT TIMING OF IMAGE FORMATION

(71) Applicant: CANON KABUSHIKI KAISHA, Tokyo (JP)

(72) Inventors: Naoki Kanno, Fujisawa (JP); Ryuichi Yoshizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/668,480

(22) Filed: Aug. 3, 2017

(65) Prior Publication Data

US 2018/0046126 A1 Feb. 15, 2018

(30) Foreign Application Priority Data

Aug. 12, 2016 (JP) ..... 2016-158386

(51) Int. Cl.
*G03G 15/01* (2006.01)
*G03G 15/00* (2006.01)
*G03G 15/16* (2006.01)

(52) U.S. Cl.
CPC ..... *G03G 15/6561* (2013.01); *G03G 15/1675* (2013.01); *G03G 15/5058* (2013.01); *G03G 2215/00721* (2013.01); *G03G 2215/0106* (2013.01); *G03G 2215/0116* (2013.01); *G03G 2215/0161* (2013.01)

(58) Field of Classification Search
CPC ..... G03G 15/5041; G03G 15/5054; G03G 15/5058; G03G 15/6561
USPC ..... 399/301
See application file for complete search history.

(56) References Cited

U.S. PATENT DOCUMENTS 7,505,057 B2 * 3/2009 Yoshida ..... G03G 15/0194 399/301
8,837,995 B2 * 9/2014 Ohashi ..... G03G 15/5058 399/301

FOREIGN PATENT DOCUMENTS

JP 1-167769 A 7/1989
JP 2001-121749 A 5/2001
JP 2011-112704 A 6/2011
JP 2014-109730 A 6/2014
JP 2014-109734 A 6/2014

* cited by examiner

*Primary Examiner* — William J Royer
(74) *Attorney, Agent, or Firm* — Canon U.S.A., Inc. IP Division

(57) ABSTRACT

An image forming apparatus includes image bearing members, an intermediate transfer member, a transfer unit, a control unit, and image forming units respectively corresponding to the image bearing members and each configured to form and transfer an image to the intermediate transfer member, which is then transferred to the conveyed recording material. Image patterns on the intermediate transfer member are detected for positional deviation detection. In a first mode, timing of image formation is determined using a first reference. In a second mode, timing of image formation is determined using a second reference. Based on timings at which formed image patterns are detected, the control unit, in the second mode, corrects timing of image formation performed by a second image forming unit or corrects timing at which the recording material is conveyed to the transfer unit.

19 Claims, 9 Drawing Sheets

IMAGE FORMING APPARATUS TO CORRECT TIMING OF IMAGE FORMATION

BACKGROUND OF THE INVENTION

Field of the Invention

The present disclosure generally relates to an electrophotographic-type color image forming apparatus.

Description of the Related Art

Heretofore, there has been known an electrophotographic-type color image forming apparatus that is equipped with an intermediate transfer belt (intermediate transfer member). In such a color image forming apparatus, first, at each of a plurality of image forming stations corresponding to the respective colors yellow, magenta, cyan, and black, a toner image is formed on a photosensitive drum (image bearing member). Then, the toner images of yellow, magenta, cyan, and black respectively formed on the plurality of photosensitive drums are sequentially transferred onto the intermediate transfer belt. With this, a color image is formed on the intermediate transfer belt. The color image formed on the intermediate transfer belt is transferred to a recording material conveyed from, for example, a cassette. Then, heat and pressure are applied to the recording material, so that the color image transferred onto the recording material is fixed to the recording material.

After outputting a vertical synchronization signal (hereinafter referred to as a "/TOP signal"), a conventional color image forming apparatus sequentially forms toner images with an image forming station located most upstream in the direction of movement of the intermediate transfer belt, for example, a yellow image forming station, used as a reference. A mode of determining image forming timing with a yellow image forming station used as a reference in this way is referred to as a "YTOP mode".

In the case of formation of a color image in the YTOP mode, first, the formation of a toner image of yellow serving as a reference is started after the /TOP signal is output. Then, the formation of toner images of magenta, cyan, and black is sequentially started. On the other hand, in the case of formation of a monochromatic image in the YTOP mode, after the /TOP signal is output, the formation of a toner image of black is started after waiting until image forming timing for yellow serving as a reference passes by and, then, magenta and cyan image forming timings pass by. The yellow, magenta, and cyan image forming stations do not start forming toner images even when the respective image forming timings are reached.

Japanese Patent Application Laid-Open No. 2001-121749 discusses a control operation for, to shorten a first print out time (FPOT) in the case of formation of a monochromatic image, allowing selecting an image forming station serving as a reference which forms a toner image first after the /TOP signal is output. According to this control operation, if, in the case of formation of a monochromatic image, a black image forming station is selected as a reference, it becomes unnecessary for the formation of a toner image of black to wait until the yellow, magenta, and cyan image forming timings pass by. Thus, it becomes possible to shorten the FPOT in the case of formation of a monochromatic image. Furthermore, a mode of determining image forming timing with a black image forming station used as a reference is referred to as a "KTOP mode".

On the other hand, Japanese Patent Application Laid-Open No. 1-167769 discusses a control operation for correcting a positional deviation of a toner image of each color (color misregistration) formed on an intermediate transfer belt. Such a positional deviation of toner images occurs due to causes, such as mechanical mounting errors of photosensitive drums of the respective image forming stations, an error of an optical path length for laser beams, and a deformation of a member caused by temperature rise. In the control operation discussed in Japanese Patent Application Laid-Open No. 1-167769, positional deviation correction patterns for the respective colors are formed on the intermediate transfer belt, and positional deviation amounts of the respective magenta, cyan, and black patterns with respect to the yellow pattern are detected. Then, the magenta, cyan, and black image forming timings are corrected based on the detected positional deviation amounts.

Here, in a case where image formation is performed in the YTOP mode, the color serving as a reference is yellow. According to the positional deviation correction control discussed in Japanese Patent Application Laid-Open No. 1-167769, the magenta, cyan, and black image forming timings are corrected to adjust the positions of the respective magenta, cyan, and black toner images with respect to the yellow toner image serving as a reference. With this, positional deviations of the respective color toner images can be reduced, so that image quality can be improved. On the other hand, in a case where image formation is performed in the KTOP mode, the color serving as a reference is black. In the KTOP mode, since a toner image is formed only at the black image forming station, positional deviation correction of the black toner image with respect to a yellow toner image is not performed.

In other words, while, in the YTOP mode, the black image forming timing is corrected in such a way as to coordinate with the position of the yellow toner image, the black image forming timing is not corrected in the KTOP mode. Because of this arrangement, even when image formation is performed with the same color image forming apparatus, the position of an image formed on a recording material in the conveyance direction (sub-scanning direction) may, in some cases, differ between the YTOP mode and the KTOP mode.

SUMMARY OF THE INVENTION

The present disclosure is generally directed to preventing the position of an image formed on a recording material from differing even when a reference color used for determining image forming timing is any color.

According to an aspect of the present invention, an image forming apparatus includes a plurality of image bearing members, an intermediate transfer member, a plurality of image forming units respectively corresponding to the plurality of image bearing members and each configured to form an image on the corresponding image bearing member and to transfer the image formed on the corresponding image bearing member to the intermediate transfer member, a conveyance unit configured to convey a recording material, a transfer unit configured to transfer the image formed on the intermediate transfer member to the recording material conveyed by the conveyance unit, a detection unit configured to detect image patterns for positional deviation detection respectively formed on the intermediate transfer member by the plurality of image forming units, and a control unit configured to perform control by switching between a first mode, which determines, with a first image forming unit among the plurality of image forming units used as a reference, timing of image formation performed by a second image forming unit different from the first image forming unit, and a second mode, which determines timing of image formation performed by the second image forming unit with the second image forming unit used as a reference, wherein, based on timings at which, in the first mode, the image pattern formed on the intermediate transfer member by the first image forming unit and the image pattern formed on the intermediate transfer member by the second image forming unit are respectively detected by the detection unit, the control unit, in the second mode, corrects timing of image formation performed by the second image forming unit or corrects timing at which the recording material is conveyed to the transfer unit by the conveyance unit.

Further features of the present invention will become apparent from the following description of embodiments with reference to the attached drawings.

DESCRIPTION OF THE EMBODIMENTS

[Overall Configuration]

Figure 1:
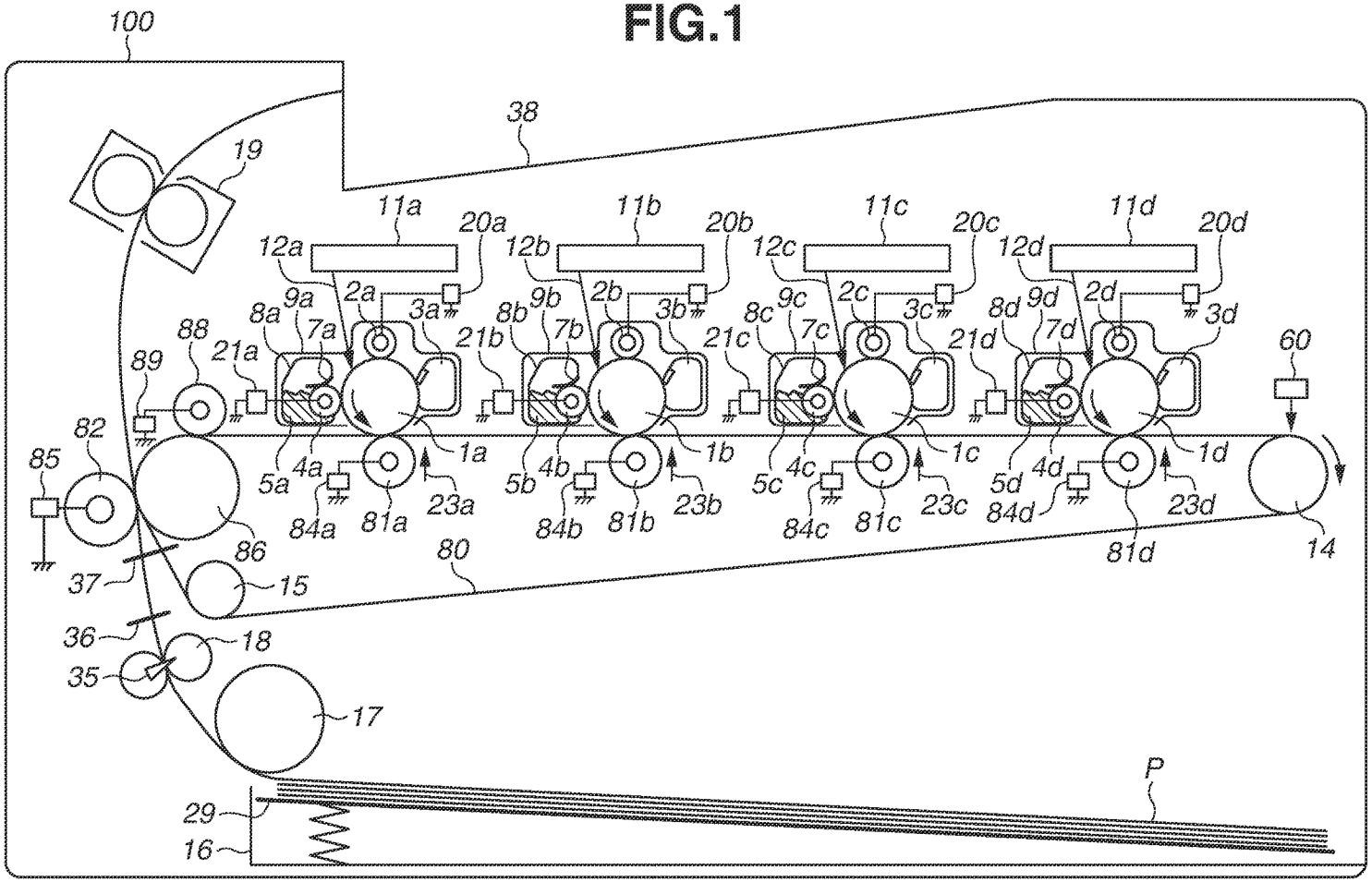
FIG. 1 is an overall configuration diagram of a laser beam printer.

An overall configuration of a color image forming apparatus is described with reference to FIG. 1. In a first embodiment, a laser beam printer is illustrated as an example of the color image forming apparatus.

[Image Forming Unit]

A laser beam printer 100 (hereinafter referred to as a "printer 100") includes four image forming stations. The first station is an image forming station which forms a yellow (Y) toner image. The second station is an image forming station which forms a magenta (M) toner image. The third station is an image forming station which forms a cyan (C) toner image. The fourth station is an image forming station which forms a black (K) toner image. Since the configurations of the respective image forming stations are the same, here, the configuration of the first station is described as a typical example.

The first station is provided with a photosensitive drum 1*a* (image bearing member). The photosensitive drum 1*a* is configured with a plurality of stacked layers of functional organic material including, for example, a carrier generation layer, which generates electric charges by being exposed to light, and a charge transport layer, which transports the generated electric charges, on a metallic cylinder, and the outermost layer thereof is low in electrical conductivity and is almost insulated. The first station is further provided with a charging roller 2*a* (charging portion). The charging roller 2*a* is kept in contact with the photosensitive drum 1*a*, and uniformly charges the surface of the photosensitive drum 1*a* while being rotated following the rotation of the photosensitive drum 1*a*. A voltage obtained by superposing direct voltages or alternating voltages is applied to the charging roller 2*a*, and electric discharge occurs at a minute air gap extending from a contact nip portion between the charging roller 2*a* and the surface of the photosensitive drum 1*a* to both the upstream and downstream sides, so that the photosensitive drum 1*a* is electrically charged. The first station is further provided with a developing unit 8*a* (developing portion). The developing unit 8*a* is configured with a developing roller 4*a* kept in contact with the photosensitive drum 1*a*, a non-magnetic one-component developer 5*a* (hereinafter referred to as "toner 5*a*"), and a developer application blade 7*a*. The first station is further provided with a cleaning unit 3*a*. The cleaning unit 3*a* cleans remaining untransferred toner on the photosensitive drum 1*a*. The above-mentioned members 1*a* to 5*a*, 7*a*, and 8*a* are formed as an integrated process cartridge 9*a*, which is detachably attached to the main body of the printer 100.

The first station is further provided with a scanner unit 11*a* (exposure portion). The scanner unit 11*a* irradiates the photosensitive drum 1*a* with a scanning beam 12*a* which is modulated based on an image signal. Additionally, the scanner unit 11*a* can be a light-emitting diode (LED) array. The first station is further provided with a primary transfer roller 81*a* (primary transfer portion). The charging roller 2*a*, the developing roller 4*a*, and the primary transfer roller 81*a* are respectively connected to a charging bias power source 20*a*, a developing bias power source 21*a*, and a primary transfer bias power source 84*a*, and thus receive voltages applied from the respective power sources.

The above is the configuration of the first station, and the second, third, and fourth stations have also the same configuration. Members of the second, third, and fourth stations are expressed with not "a" but "b", "c", and "d" added to the ends of the respective same reference numerals indicating the members of the first station.

An intermediate transfer belt 80 (intermediate transfer member) is supported by three rollers, i.e., a secondary transfer counter roller 86, a driving roller 14, and a tension roller 15, which act as tensioning members for the intermediate transfer belt 80, and is kept tensioned. When the driving roller 14 is driven, the intermediate transfer belt 80 rotates in the direction of an arrow illustrated in FIG. 1. Furthermore, destaticizing members 23*a* to 23*d* are respectively located at the downstream sides of the primary transfer rollers 81*a* to 81*d* in the rotational direction of the intermediate transfer belt 80. The driving roller 14, the tension roller 15, the destaticizing members 23*a* to 23*d*, and the secondary transfer counter roller 86 are electrically grounded. A cleaning roller 88 cleans remaining untransferred toner on the intermediate transfer belt 80. The cleaning roller 88 is connected to a cleaning bias power source 89 and is configured to receive a voltage applied from the cleaning bias power source 89.

Next, an image forming process is described. The photosensitive drum 1*a* in the first station is configured by applying an organic photo conductor (OPC) layer onto the outer circumferential surface of an aluminum cylinder. Both end portions of the photosensitive drum 1*a* are rotatably supported by flanges, and, when drive force is transmitted from a drive motor (not illustrated) to one end portion, the photosensitive drum 1*a* rotates in the direction of an arrow illustrated in FIG. 1. The photosensitive drum 1*a* and the intermediate transfer belt rotate at approximately the same speed. When the charging roller 2*a*, which is a conductive roller, is kept in contact with the surface of the photosensitive drum 1*a* and a charging bias voltage is applied from the charging bias power source 20*a*, the surface of the photosensitive drum 1*a* is uniformly charged. The scanner unit 11*a* includes a polygon mirror, and the polygon mirror is irradiated with light corresponding to an image signal emitted from a laser diode (not illustrated). With this, the scanner unit 11*a* forms an electrostatic latent image on the photosensitive drum 1*a*. The developing roller 4*a* is in abutment with the photosensitive drum 1*a*, and, when being driven to rotate by a drive motor (not illustrated) and receiving a voltage applied from the developing bias power source 21*a*, supplies yellow toner 5*a* to the photosensitive drum 1*a*. With this, the developing roller 4*a* forms a yellow toner image on the photosensitive drum 1*a*. In the second, third, and fourth stations, toner images are also formed on the respective photosensitive drums 1*b* to 1*d* by similar image forming processes. Furthermore, as mentioned above, a magenta toner image is formed on the photosensitive drum 1*b*, a cyan toner image is formed on the photosensitive drum 1*c*, and a black toner image is formed on the photosensitive drum 1*d*.

Inside the intermediate transfer belt 80, primary transfer rollers 81*a* to 81*d* which are in contact with the intermediate transfer belt 80 are located respectively opposite to the four photosensitive drums 1*a* to 1*d*. Upon receiving voltages respectively applied from the primary transfer bias power sources 84*a* to 84*d*, the primary transfer rollers 81*a* to 81*d* sequentially transfer negative-polarity toner images formed on the respective photosensitive drums 1*a* to 1*d* to the intermediate transfer belt 80. With this, a color toner image is formed on the intermediate transfer belt 80.

[Sheet Feed and Conveyance Unit]

A plurality of sheets P (recording materials) are placed on a cassette 16. A pickup roller 17 is driven to feed a sheet P from the cassette 16. As the pickup roller 17 is driven, a cassette bottom plate 29 moves upward to push up the sheets P placed on the cassette 16. Then, the uppermost pushed-up sheet P contacts the pickup roller 17 and is fed by the rotation of the pickup roller 17. A registration sensor 35 detects the leading edge of the fed sheet P. Here, the leading edge of a sheet P is a downstream-side edge of the sheet P in the conveyance direction of the sheet P. The conveyance of the sheet P continues for a predetermined time after the registration sensor 35 detects the leading edge of the sheet P, and, at timing at which the leading edge of the sheet P arrives at a temporary stop position 36, the conveyance of the sheet P is suspended.

After that, the conveyance of the sheet P fed by the pickup roller 17 is resumed by a registration roller 18. The registration roller 18 conveys the sheet P to a secondary transfer position in such a manner that the leading edge of an image formed on the intermediate transfer belt 80 and the leading edge of the sheet P accord with each other at a merge point 37. The secondary transfer position is a contact portion between a secondary transfer roller 82 and the intermediate transfer belt 80. The secondary transfer roller 82 is connected to a secondary transfer bias power source 85, and is configured to receive a voltage applied therefrom. During conveyance of the sheet P, when the voltage is applied to the secondary transfer roller 82, an electric field is formed between the secondary transfer roller 82 and the secondary transfer counter roller 86, which is located opposite thereto, so that dielectric polarization occurs between the intermediate transfer belt 80 and the sheet P. With this, electrostatic attraction force is generated between them. Then, the toner image formed on the intermediate transfer belt 80 is transferred to the sheet P.

[Fixing Unit]

A fixing device 19 applies heat and pressure to the sheet P to fix the transferred toner image to the sheet P. The fixing device 19 includes a fixing belt and an elastic pressing roller. The elastic pressing roller sandwiches the fixing belt with a belt guide member (not illustrated) at a predetermined pressing contact force to form a fixing nip portion having a predetermined width. When the temperature of the fixing nip portion is increased and then controlled to a predetermined temperature, the sheet P having the unfixed toner image formed thereon is conveyed to a space between the fixing belt and the elastic pressing roller at the fixing nip portion. At this time, the sheet P is introduced with the image surface thereof faced up, in other words, facing the surface of the fixing belt, and the sheet P is conveyed together with the fixing belt at the fixing nip portion with the image surface closely contacting the outer surface of the fixing belt at the fixing nip portion. During the process in which the sheet P is conveyed together with the fixing belt at the fixing nip portion, the sheet P is heated by the fixing belt, so that the unfixed toner image on the sheet P is heated and fixed. After that, the sheet P having the toner image P fixed thereto is discharged to a sheet discharge tray 38 by the fixing device 19.

[Detection Unit]

A positional deviation detection sensor unit 60 (hereinafter referred to as a "sensor unit 60") detects image patterns for positional deviation detection of the respective color images transferred to the intermediate transfer belt 80. Although details are described below, the sensor unit 60 includes two sensors which detect image patterns. Providing two sensors allows detecting the scaling factor of an image in the main scanning direction or the inclination thereof in the sub-scanning direction.

[Control Block Diagram]

Figure 2:
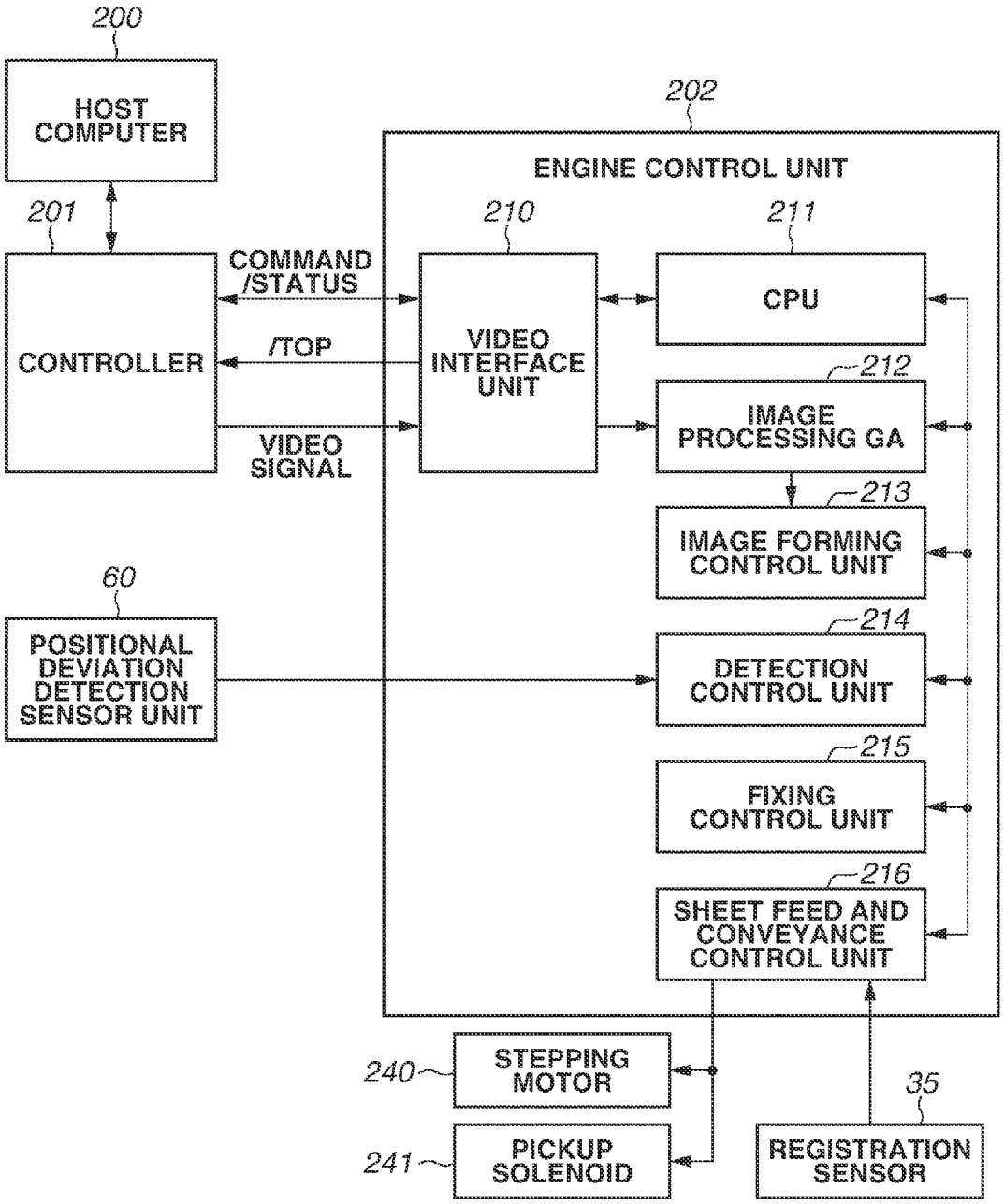
FIG. 2 is a system configuration diagram of the laser beam printer.

FIG. 2 is a block diagram illustrating a system configuration of the printer 100. A controller 201 is configured to be able to mutually communicate with a host computer 200 and an engine control unit 202. When performing positional deviation correction control, which is described below, the controller 201 transmits a start instruction for positional deviation correction control and a video signal to a central processing unit (CPU) 211 and an image processing gate array (GA) 212. Moreover, the controller 201 receives image information and a printing instruction from the host computer 200, and analyzes and converts the received image information into bit data. Then, the controller 201 transmits a printing color mode specified for each sheet P, a specified /TOP signal reference color, a printing start instruction, and a video signal to the CPU 211 and the image processing GA 212 via a video interface unit 210.

[Outline of Positional Deviation Correction Control]

Upon receiving a start instruction for positional deviation correction control, the CPU 211 instructs an image forming control unit 213 to form image patterns for positional deviation detection. Upon receiving the start instruction for positional deviation correction control, the image forming control unit 213 applies various biases to prepare formation of image patterns. When the preparation of various biases is completed, the CPU 211 outputs the /TOP signal (reference signal) to the controller 201. Upon receiving the /TOP signal from the CPU 211, the controller 201 outputs a video signal of image patterns for positional deviation detection. Upon receiving the video signal from the controller 201, the image processing GA 212 transmits image forming data to the image forming control unit 213. The image forming control unit 213 causes the scanner units 11*a* to 11*d* to start forming electrostatic latent images on the respective photosensitive drums 1*a* to 1*d* based on the image forming data received from the image processing GA 212. Then, the image forming control unit 213 causes toner images to be formed on the respective photosensitive drums 1*a* to 1*d*, and causes the toner images formed on the photosensitive drums 1*a* to 1*d* to be transferred to the intermediate transfer belt 80. The sensor unit 60 detects an image pattern formed on the intermediate transfer belt 80, and outputs a voltage value corresponding to the toner density to a detection control unit 214. The detection control unit 214 calculates positional deviation amounts of each color toner image in the main scanning and sub-scanning directions based on a result of detection by the sensor unit 60. Furthermore, this calculation can be performed by the CPU 211. The CPU 211 transmits the positional deviation amounts to the controller 201 via the video interface unit 210.

[Outline of Image Forming Control]

The controller 201 transmits, to the CPU 211 via the video interface unit 210, a specified printing color mode and a specified /TOP signal reference color according to the printing instruction from the host computer 200. Then, at timing at which printing becomes ready, the controller 201 transmits a printing start instruction to the CPU 211 via the video interface unit 210. The CPU 211 makes preparations according to specifications received from the controller 201, and waits for a printing start instruction from the controller 201. Upon receiving the printing start instruction, the CPU 211 issues instructions to various control units (the image forming control unit 213, a fixing control unit 215, and a sheet feed and conveyance control unit 216) to start a printing operation according to the printing conditions specified by the controller 201. Upon receiving the instruction to start a printing operation, the image forming control unit 213 starts preparations for image formation.

Upon receiving a notification indicating the completion of preparations for image formation from the image forming control unit 213, the CPU 211 outputs the /TOP signal, which serves as reference timing for outputting of a video signal, to the controller 201. Upon receiving the /TOP signal from the CPU 211, the controller 201 outputs video signals for the respective colors with the /TOP signal used as a reference. The color for which the controller 201 first writes an image with the /TOP signal used as a reference is a color specified by a /TOP signal reference color specifying command. When yellow is specified as a reference color, the controller 201 starts outputting a video signal for yellow with the timing of reception of the /TOP signal used as a reference, and then outputs video signals in the order of magenta, cyan, and black. On the other hand, when black is specified as a reference color, the controller 201 outputs a video signal for black with the timing of reception of the /TOP signal used as a reference.

In this way, the printer 100 according to the present embodiment is configured to be able to specify a color for which an image is first written with the /TOP signal used as a reference. Hereinafter, a mode of determining image forming timing with yellow used as a reference is referred to as a "YTOP mode", and a mode of determining image forming timing with black used as a reference is referred to as a "KTOP mode".

Upon receiving the video signal from the controller 201, the image processing GA 212 transmits image forming data to the image forming control unit 213. The image forming control unit 213 performs image formation based on the image forming data received from the image processing GA 212.

[Outline of Leading Edge Position Adjustment Control]

The printer 100 performs control in such a manner that the leading edge of a toner image formed on the intermediate transfer belt 80 and the leading edge of the sheet P accord with each other at the secondary transfer position, and thus forms an image at an intended position on the sheet P (hereinafter referred to as "leading edge position adjustment control"). The leading edge position of a toner image formed on the intermediate transfer belt 80 is determined with the /TOP signal used as a reference.

Upon receiving the printing operation start instruction, the sheet feed and conveyance control unit 216 starts a sheet feed operation. The sheet feed and conveyance control unit 216 rotates the pickup roller 17 by rotating a stepping motor 240 via a motor driver integrated circuit (IC) (not illustrated) and, after a predetermined time, activating a pickup solenoid 241. With this, a sheet P is fed from the cassette 16. The sheet feed and conveyance control unit 216 temporarily stops conveyance of the sheet P at timing at which the leading edge of the sheet P arrives at the temporary stop position 36 based on the timing at which the leading edge of the fed sheet P is detected by the registration sensor 35.

The CPU 211 estimates timing at which the leading edge of the toner image formed on the intermediate transfer belt 80 arrives at the merge point 37 with the /TOP signal used as a reference. Then, the CPU 211 issues an instruction to the sheet feed and conveyance control unit 216 to resume conveyance of the sheet P, which has been temporarily stopped, in conformity with the estimated timing. The sheet feed and conveyance control unit 216 resumes conveyance of the sheet P according to the instruction for resumption of conveyance of the sheet P, so that a toner image can be transferred to an intended position on the sheet P.

Upon receiving the printing operation start instruction, the fixing control unit 215 starts preparations for fixing. The fixing control unit 215 starts temperature adjustment according to the printing information in conformity with timing at which the sheet P having the toner image transferred thereto is conveyed. The fixing control unit 215 causes the toner image to be fixed to the sheet P, and then causes the sheet P to be discharged to the sheet discharge tray 38.

[Details of Positional Deviation Correction Control]

Next, a configuration of the sensor unit 60 is described with reference to FIGS. 3A and 3B, and the details of the positional deviation correction control using the sensor unit 60 are described.

Figure 3A:
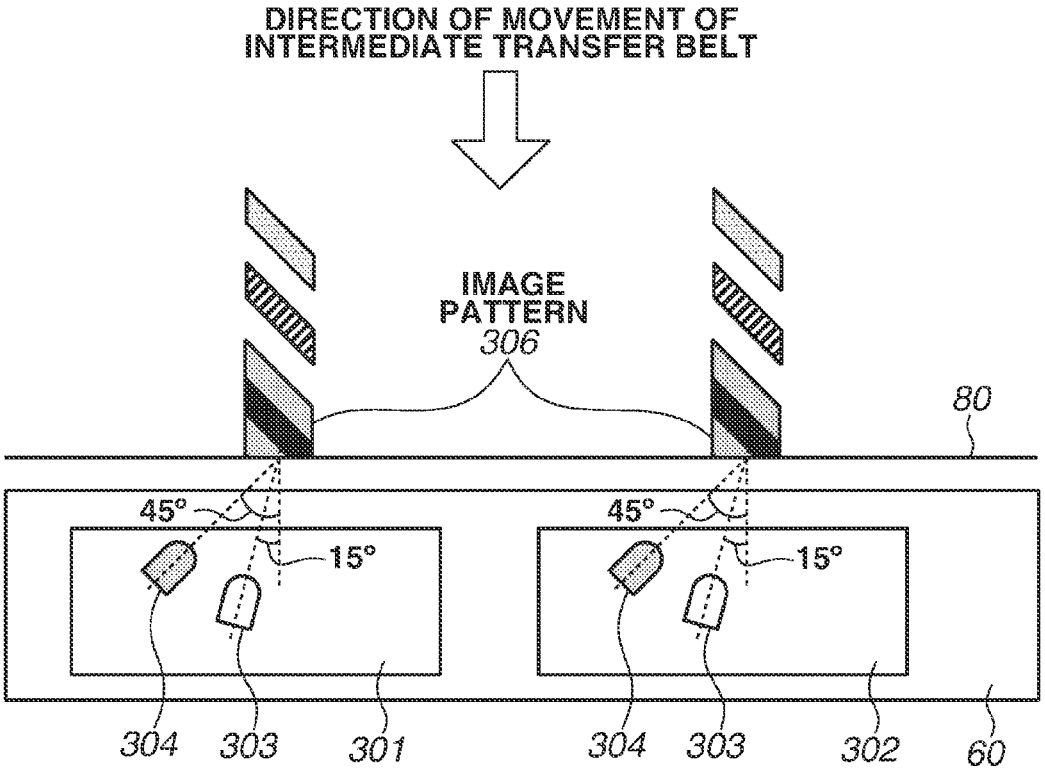
FIGS. 3A and 3B are system configuration diagrams of a positional deviation detection sensor unit.

FIG. 3A illustrates an example of a configuration of the sensor unit 60. The sensor unit 60 includes two positional deviation detection sensors 301 and 302 (hereinafter referred to as "sensors 301 and 302"). As illustrated in FIG. 3A, the sensors 301 and 302 are located at respective positions different in a direction perpendicular to the direction of movement of the intermediate transfer belt 80.

Each of the sensors 301 and 302 has a light-emitting element 303 (light-emitting portion), which emits light onto the intermediate transfer belt 80 or an image pattern 306 for positional deviation detection formed on the intermediate transfer belt 80. Moreover, each of the sensors 301 and 302 has a light-receiving element 304 (light-receiving portion), which receives diffusely-reflected light from the intermediate transfer belt 80 or the image pattern 306. The light-emitting element 303 is located in such a way as to have an irradiation angle of 15° with respect to the direction of a perpendicular of the intermediate transfer belt 80. The light-receiving element 304 is located in such a way as to have a light-receiving angle of 45° so as to detect the diffusely-reflected light from the intermediate transfer belt 80.

Figure 3B:
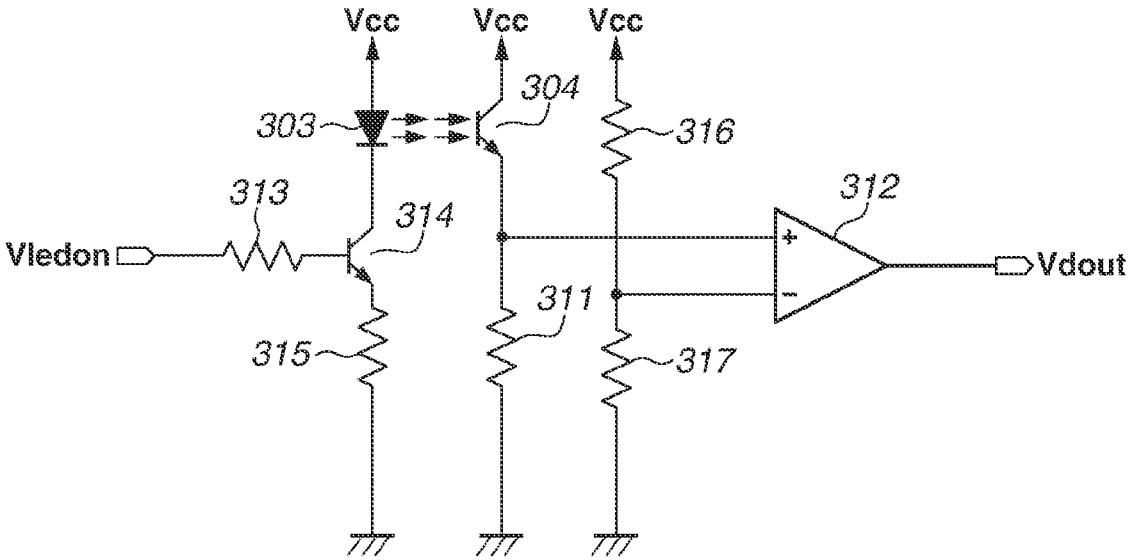

FIG. 3B illustrates a drive circuit of each of the sensors 301 and 302. The light-emitting element 303 emits light in response to a light-emitting element drive signal Vledon input from the CPU 211. The light-emitting element drive signal Vledon is used to perform light emission control by driving a switching element 314, such as a transistor, via a base resistor 313 and controlling a current flowing through the light-emitting element 303 via a current-limiting resistor 315. When the diffusely-reflected light from the intermediate transfer belt 80 or the image pattern 306 is received by the light-receiving element 304, a current corresponding to the amount of the received light flows through a resistor 311, so that the diffusely-reflected light is photoelectrically converted and is then detected as an analog output signal. The voltage of the detected analog output signal and a reference voltage obtained by binarization with a desired threshold voltage using voltage-dividing resistors 316 and 317 are compared with each other by, for example, a comparator 312, so that the analog output signal is converted into a digital output signal Vdout. Timings of the rising edge and falling edge of the digital output signal Vdout are detected by an arithmetic processing unit having a time-series inputting function, such as the CPU 211, and are then sequentially stored.

[Method of Positional Deviation Detection]

Next, a method of calculating the positional deviation amount of each color based on a result of detection of the image pattern 306 for positional deviation detection is described in detail. Furthermore, a calculation described below is performed by the detection control unit 214. The positional deviation amount is calculated by computing the amount of positional deviation between an image pattern of a reference color and an image pattern of a measurement color. In the present embodiment, the reference color is yellow. Thus, to what extent an image pattern of another color relatively deviates from an image pattern of yellow is calculated.

Figure 4A:
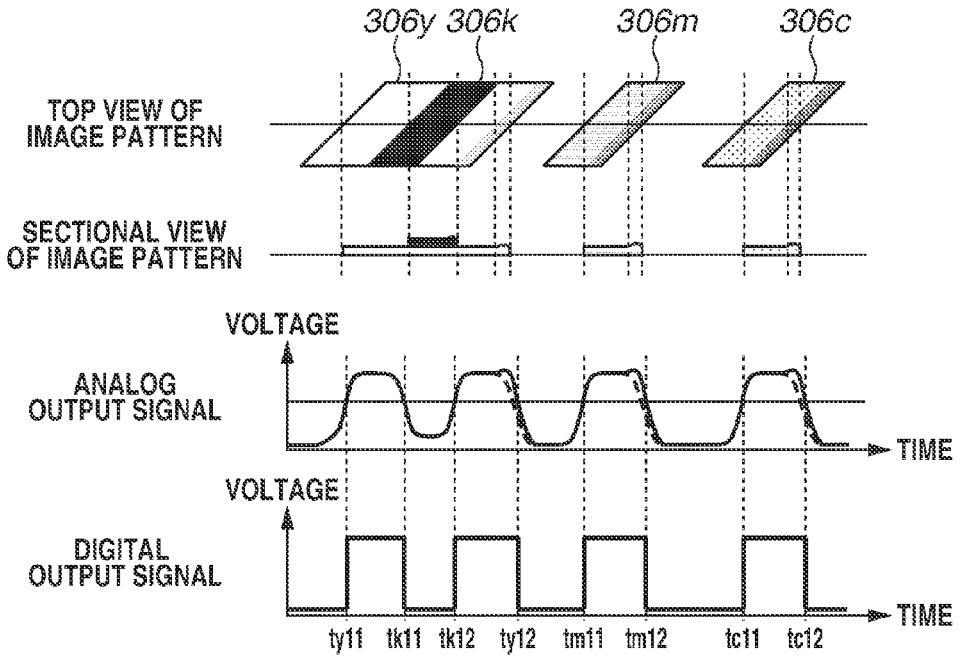
FIGS. 4A and 4B are diagrams used for describing a method of calculating a positional deviation amount.
Figure 4B:
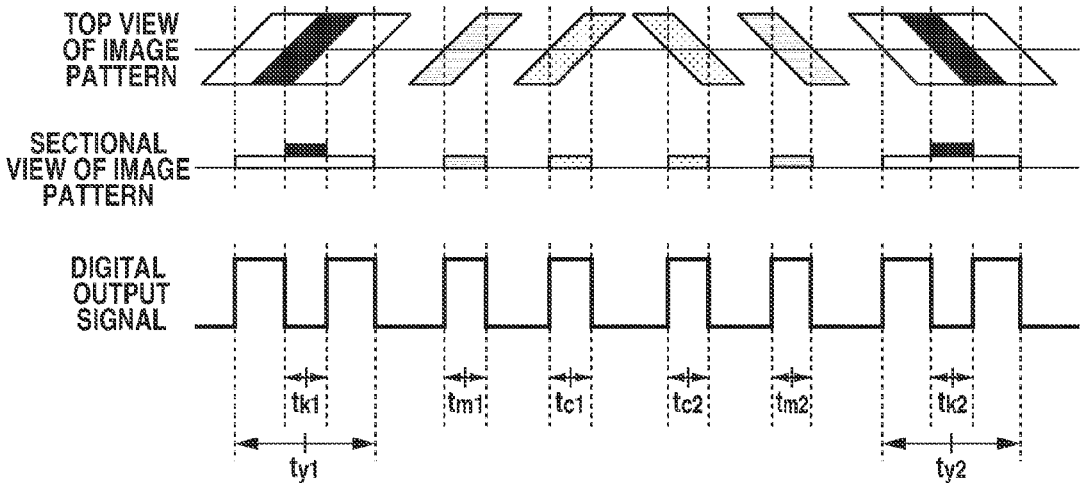

FIG. 4A illustrates image patterns 306 of the respective colors and waveforms of output signals obtained by the sensor 301 (or the sensor 302) detecting the image patterns 306. In FIG. 4A, the image patterns 306 include a yellow image pattern 306*y*, a magenta image pattern 306*m*, a cyan image pattern 306*c*, and a black image pattern 306*k*. The reason why the black image pattern 306*k* is formed on the yellow image pattern 306*y* is that, since the color of the intermediate transfer belt 80 is close to black, if the black image pattern 306*k* is solely formed, it becomes difficult to detect edges thereof. In FIG. 4A, times t corresponding to rising edges and falling edges of output signals corresponding to the respective image patterns are denoted by ty11, ty12, tk11, tk12, tm11, tm12, tc11, and tc12. Furthermore, actually, a plurality of image patterns 306 is formed for each color, as illustrated in FIG. 4B. Here, the central value of each color image pattern 306 is calculated by the following equations.

$$tk1=(tk11+tk12)/2$$

$$ty1=(ty11+ty12)/2$$

$$tm1=(tm11+tm12)/2$$

$$tc1=(tc11+tc12)/2$$

$$tk2=(tk21+tk22)/2$$

$$ty2=(ty21+ty22)/2$$

$$tm2=(tm21+tm22)/2$$

$$tc2=(tc21+tc22)/2$$

The positional deviation times of the respective color image patterns 306 with respect to yellow serving as a reference color are respectively calculated based on the calculated central vales by the following equations.

Sub-Scanning Positional Deviation Time of Black:

$$Sk_val=((tk1-ty1)+(tk2-ty2))/2$$

Sub-Scanning Positional Deviation Time of Magenta:

$$Sm_val=((tm1-ty1)+(tm2-ty2))/2$$

Sub-Scanning Positional Deviation Time of Cyan:

$$Sc_val=((tc1-ty1)+(tc2-ty2))/2$$

The relative positional deviation amount of a writing start position in the sub-scanning direction is calculated by performing the above computations for each pattern set and obtaining the average of all of the sets. Here, a case where the calculated positional deviation time is positive indicates that the writing start timing of a measurement color is late with respect to that of yellow serving as a reference color. On the other hand, a case where the calculated positional deviation time is negative indicates that the writing start timing of a measurement color is early with respect to that of yellow serving as a reference color. Moreover, the default writing start timing of each color is calculated from an interval between the respective color stations. The initial positional deviation correction is performed to calculate the deviation amount with respect to the default writing start position.

[Positional Deviation Correction Control in YTOP Mode]

Figure 5A:
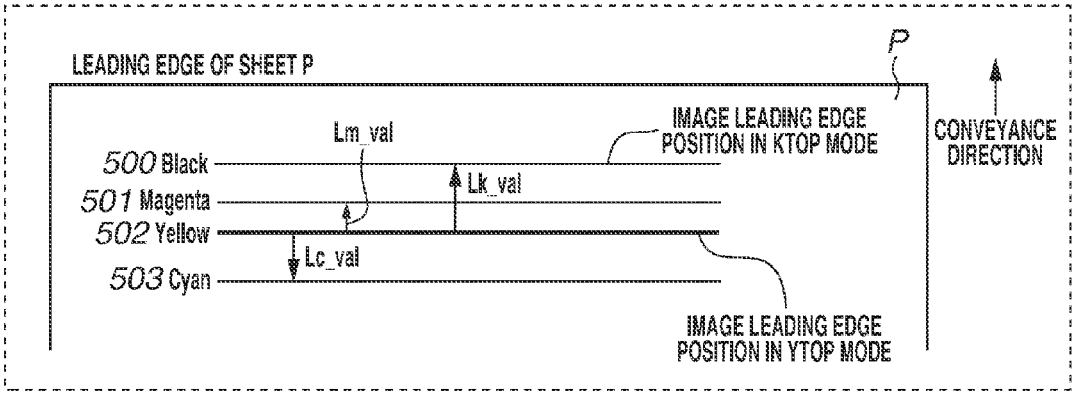
FIGS. 5A and 5B are timing charts illustrating positional deviation correction control when the YTOP mode is set.

The positional deviation correction control in the YTOP mode is described with reference to FIGS. 5A and 5B. FIG. 5A illustrates a relationship between the positional deviation amount and the leading edge position of a toner image in a case where an image forming station of each color performs image formation at the default writing start position.

Referring to FIG. 5A, it can be found that the leading edge position of a magenta toner image (501) deviates from the leading edge position of a toner image of yellow (502), serving as a reference color, by Lm_val toward the downstream side in the conveyance direction of the sheet P. Moreover, it can be found that the leading edge position of a cyan toner image (503) deviates from the leading edge position of a yellow toner image (502) by Lc_val toward the upstream side in the conveyance direction of the sheet P. Additionally, it can be found that the leading edge position of a black toner image (500) deviates from the leading edge position of a yellow toner image (502) by Lk_val toward the downstream side in the conveyance direction of the sheet P. Furthermore, Lm_val, Lc_val, and Lk_val are the lengths of positional deviation respectively corresponding to the positional deviation times Sm_val, Sc_val, and Sk_val.

Figure 5B:
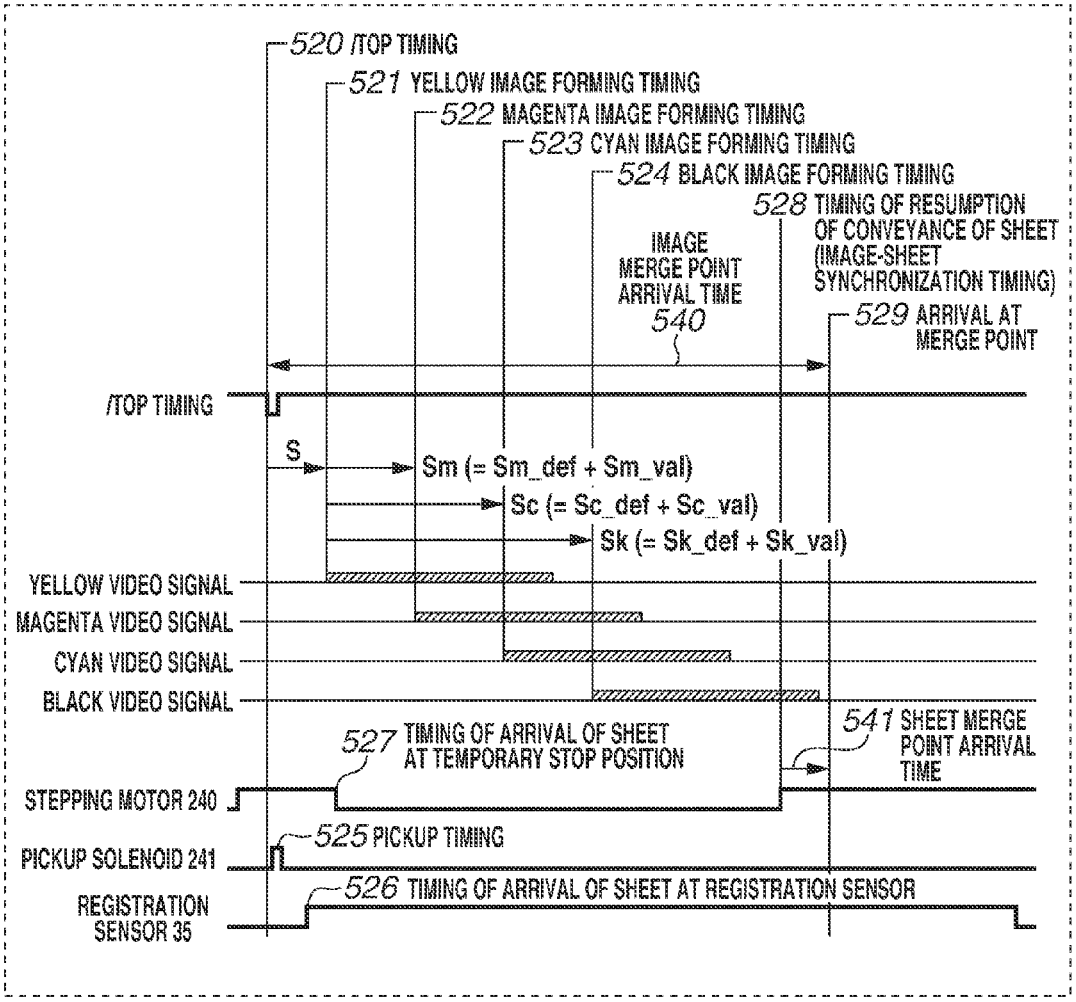

FIG. 5B is a timing chart at the time of printing a full-color image (an image with a plurality of colors). Upon receiving a printing start instruction from the controller 201, the engine control unit 202 starts preparations for image formation, and, when completing the preparations, outputs the /TOP signal (520) to the controller 201. Upon receiving the /TOP signal (520), the controller 201 determines image forming timings of magenta, cyan, and black (522, 523, and 524) with image forming timing of yellow (521) used as a reference. Then, the controller 201 outputs video signals at the respective image forming timings, and the engine control unit 202 causes the scanner units 11*a* to 11*d* to perform writing of respective electrostatic latent images.

The controller 201 performs image formation of yellow (521) at timing at which a first predetermined time S has elapsed from when the engine control unit 202 outputs the /TOP signal (520). The first predetermined time S is a fixed time determined according to the characteristics of the controller 201, such as a time required for the controller 201 to perform image processing. The controller 201 performs image formation of magenta, cyan, and black at respective timings at which correction times Sm, Sc, and Sk have elapsed with the yellow image forming timing (521) used as a reference.

A method of obtaining the correction times Sm, Sc, and Sk is described. Default writing start timings of magenta, cyan, and black (the writing start positions in the case of no positional deviation) are respective timings at which second predetermined times Sm_def, Sc_def, and Sk_def have elapsed from the yellow image forming timing (521). In a case where the positional deviation times of magenta, cyan, and black calculated according to the above-mentioned method are denoted by Sm_val, Sc_val, and Sk_val, image forming timings of the respective colors are calculated by the following equations.

$$Sm=Sm_\mathrm{def}+Sm_\mathrm{val}$$

$$Sc=Sc_\mathrm{def}+Sc_\mathrm{val}$$

$$Sk=Sk_\mathrm{def}+Sk_\mathrm{val}$$

Default writing start timings of the respective colors are determined based on an interval between station of yellow and the stations of other colors. When a distance between adjacent image forming stations is denoted by M and the speed of the intermediate transfer belt 80 is denoted by PS, the default writing start timings of the respective colors are calculated by the following equations.

$$Sm_\mathrm{def}=M/PS$$

$$Sc_\mathrm{def}=M\times 2/PS$$

$$Sk_\mathrm{def}=M\times 3/PS$$

The sheet feed and conveyance control unit 216 drives the stepping motor 240 at timing of receipt of the printing start instruction from the controller 201. After that, the sheet feed and conveyance control unit 216 drives the pickup solenoid 241 (525) to feed a sheet P placed on the cassette 16. When the leading edge of the fed sheet P is detected by the registration sensor 35 (526), the sheet feed and conveyance control unit 216 conveys the sheet P to the temporary stop position 36 and then temporarily stops conveyance of the sheet P there (527).

The engine control unit 202 performs control in such a manner that the leading edge of the sheet P and the leading edge of the toner image accord with each other at the merge point 37. An image merge point arrival time (540) from the output timing of the /TOP signal (520) until the leading edge of a toner image formed on the intermediate transfer belt 80 arrives at the merge point 37 is previously calculated from the dimensions of the associated members. Moreover, a sheet merge point arrival time (541) required to convey the sheet P from the temporary stop position 36 to the merge point 37 is previously calculated based on the length of a conveyance path and the conveyance speed of the sheet P.

The engine control unit 202 resumes conveyance of the sheet P in conformity with timing at which the leading edge of the toner image formed on the intermediate transfer belt 80 arrives at the merge point 37 (529), thus forming a toner image at an intended position on the sheet P. More specifically, the engine control unit 202 calculates the timing at which the leading edge of the toner image arrives at the merge point 37 (529) based on the image merge point arrival time (540), and resumes conveyance of the sheet P at timing (528) earlier than the calculated timing by the sheet merge point arrival time (541).

[Timing Chart of Positional Deviation Correction Control in KTOP Mode)

Next, positional deviation correction control in the KTOP mode is described with reference to FIGS. 6A and 6B. In the present embodiment, in order to prevent the position of a toner image formed on a sheet P from differing in comparing the positions between the YTOP mode and the KTOP mode, positional deviation correction control is also performed in the KTOP mode.

Figure 6A:
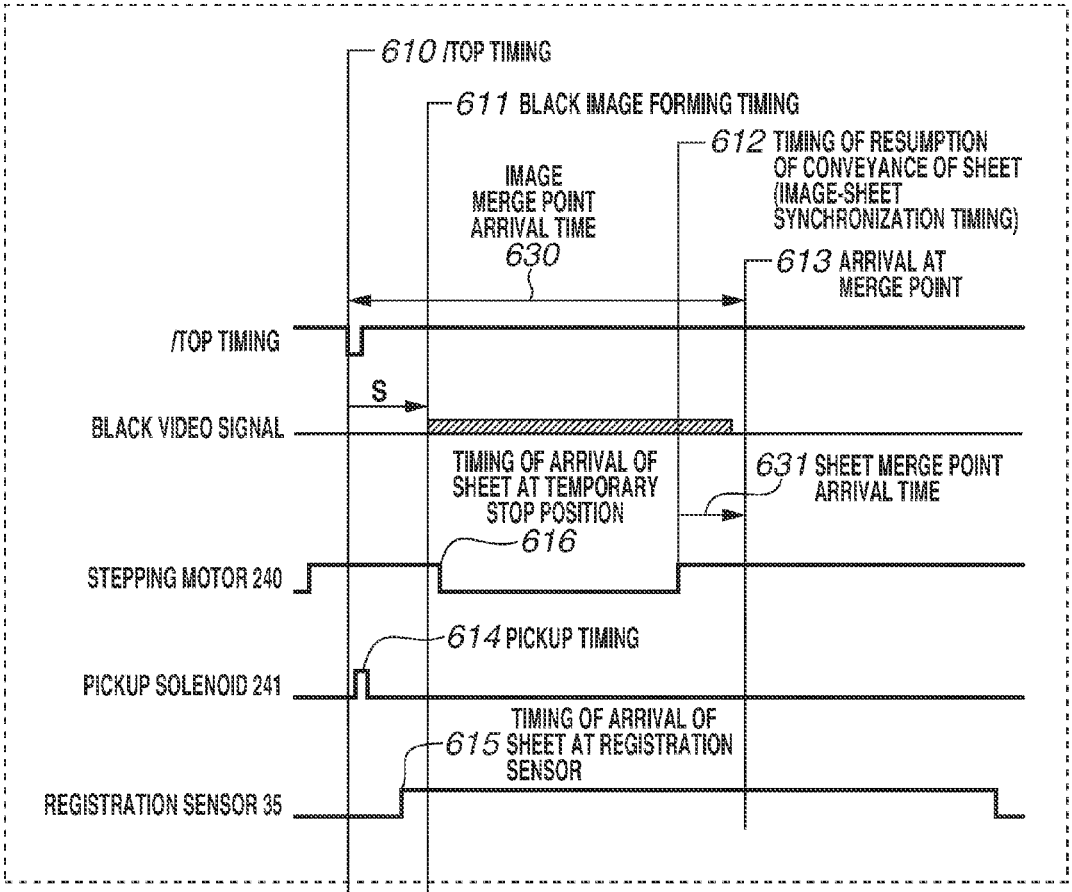
FIGS. 6A and 6B are timing charts illustrating positional deviation correction control when the KTOP mode is set.

FIG. 6A is a timing chart at the time of printing a monochromatic image (an image with a single color). FIG. 6A illustrates default writing start timing before positional deviation correction control is performed. As with the YTOP mode, upon receiving a printing start instruction from the controller 201, the engine control unit 202 starts preparations for image formation, and, when completing the preparations, outputs the /TOP signal (610) to the controller 201. Upon receiving the /TOP signal (610) from the engine control unit 202, the controller 201 outputs a video signal at image forming timing of black, and the engine control unit 202 causes the scanner unit 11*d* to perform writing of an electrostatic latent image.

The controller 201 performs image formation of black (611) at timing at which a first predetermined time S has elapsed from when the engine control unit 202 outputs the /TOP signal (610). The first predetermined time S is a time the length of which is the same as that in the YTOP mode. Control operations for the stepping motor 240 and the pickup solenoid 241 are similar to those in the YTOP mode. In other words, referring to FIG. 6A, the pickup solenoid 241 is driven at timing 614, the leading edge of the sheet P is detected by the registration sensor 35 at timing 615, and the sheet P arrives at the temporary stop position 36 at timing 616.

The engine control unit 202 performs control in such a manner that the leading edge of the sheet P and the leading edge of the toner image accord with each other at the merge point 37. An image merge point arrival time (630) is shorter than in the YTOP mode by a time corresponding to the distance from the first station (yellow) to the fourth station (black). A sheet merge point arrival time (631) is previously calculated based on the length of a conveyance path and the conveyance speed of the sheet P.

The engine control unit 202 resumes conveyance of the sheet P in conformity with timing at which the leading edge of the toner image formed on the intermediate transfer belt 80 arrives at the merge point 37 (613), thus forming a toner image at an intended position on the sheet P. More specifically, the engine control unit 202 calculates the timing at which the leading edge of the toner image arrives at the merge point 37 (613) based on the image merge point arrival time (630), and resumes conveyance of the sheet P at timing (612) earlier than the calculated timing by the sheet merge point arrival time (631).

In this way, the image forming timing of black in the KTOP mode is the same as the image forming timing of yellow in the YTOP mode. However, as illustrated in FIG. 5A, the leading edge position (502) of a yellow toner image and the leading edge position (500) of a black toner image deviate from each other by Lk_val. In other words, when the printer 100 performs image formation in the YTOP mode and image formation in the KTOP mode, the leading edge position of a toner image with respect to the sheet P differs by Lk_val.

Figure 6B:
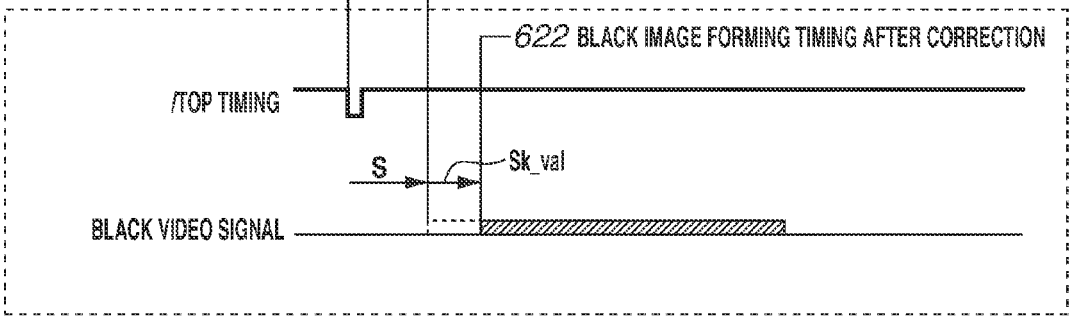

Therefore, the present embodiment corrects the writing start timing of black as illustrated in FIG. 6B as a method of resolving image leading edge positional deviation occurring due to a difference between the YTOP mode and the KTOP mode. In other words, in the case of the KTOP mode, the writing start position is corrected by a positional deviation time of black Sk_val with respect to yellow (622).

[Flowchart of Positional Deviation Correction Control in the Present Embodiment]

Figure 7:
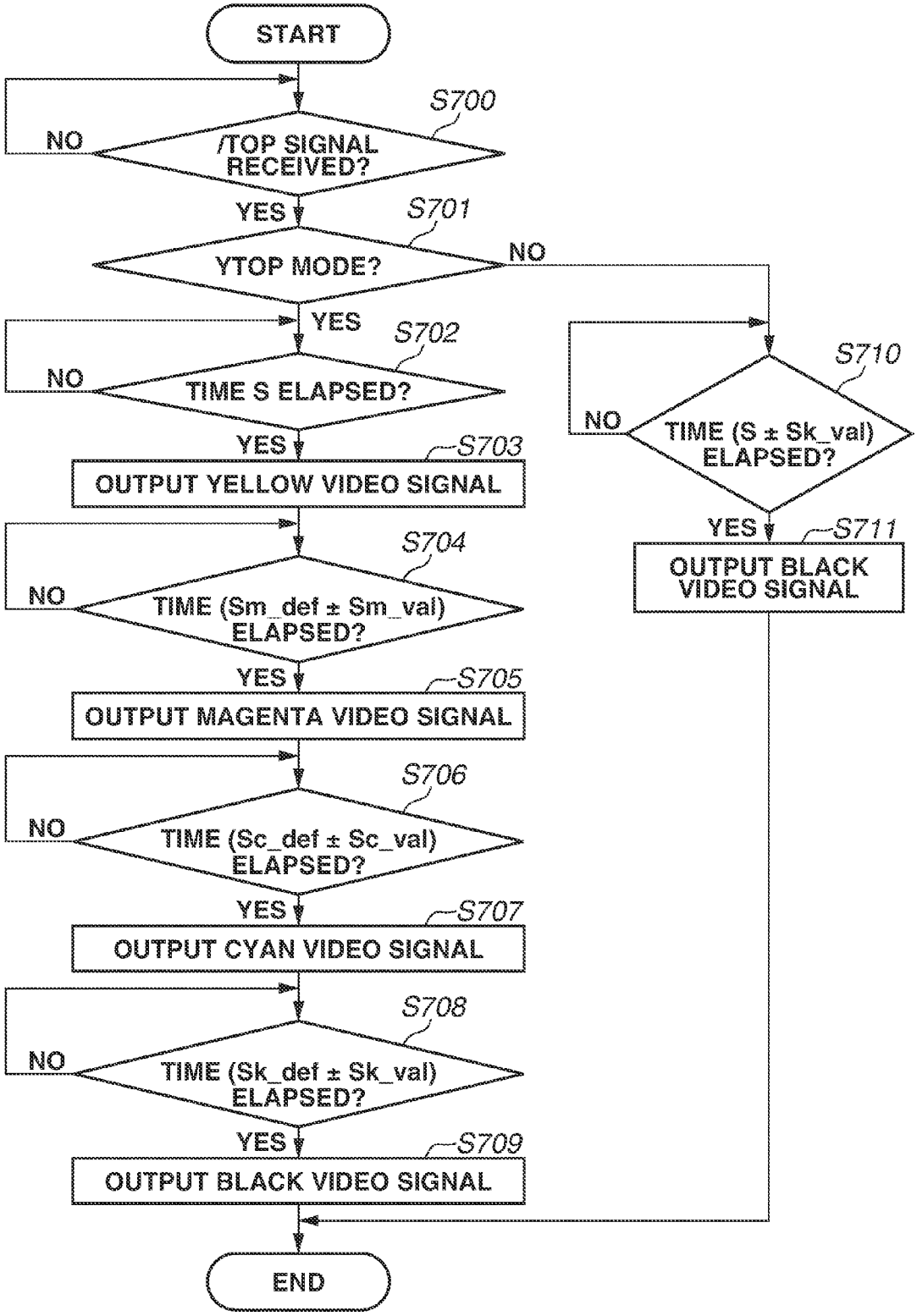
FIG. 7 is a flowchart illustrating positional deviation correction control in a first embodiment.

FIG. 7 is a flowchart of positional deviation correction control in the present embodiment. Control operations which are based on the flowchart of FIG. 7 are performed by the controller 201 executing a program stored in, for example, a read-only memory (ROM).

First, in step S700, the controller 201 waits for the /TOP signal to be received from the engine control unit 202. Upon receiving the /TOP signal (YES in step S700), then in step S701, the controller 201 determines whether the printer 100 is in the YTOP mode or the KTOP mode.

When the printer 100 is in the YTOP mode (YES in step S701), then in step S702, the controller 201 waits for a first predetermined time S to elapse from the time of reception of the /TOP signal, and, then in step S703, outputs a yellow video signal. After that, in step S704, the controller 201 waits for a time (Sm_def±Sm_val) to elapse from the start of outputting of the yellow video signal, and, then in step S705, outputs a magenta video signal. Then, in step S706, the controller 201 waits for a time (Sc_def±Sc_val) to elapse from the start of outputting of the yellow video signal, and, then in step S707, outputs a cyan video signal. Then, in step S708, the controller 201 waits for a time (Sk_def±Sk_val) to elapse from the start of outputting of the yellow video signal, and, then in step S709, outputs a black video signal.

When the printer 100 is in the KTOP mode (NO in step S701), then in step S710, the controller 201 waits for a first predetermined time (S±Sk_val) to elapse from the time of reception of the /TOP signal, and, then in step S711, outputs a black video signal. Then, the above-described control operations in the present flowchart end.

As described above, according to the present embodiment, even in a case where a different color is used as a reference color for determining image forming timing, image writing start timing is corrected, so that the position of an image formed on a recording material can be prevented from differing.

In the first embodiment, a method in which the controller 201 corrects an image writing start position to prevent the leading edge position of an image with respect to the sheet P from varying to whatever color the /TOP signal reference color is set has been described. In a second embodiment, a method in which the engine control unit 202 controls conveyance of the sheet P to adjust the leading edge position of an image with respect to the sheet P is described. The description of main portions is the same as that in the first embodiment, and, here, only portions different from those in the first embodiment are described.

[Timing Chart of Leading Edge Position Adjustment Control in KTOP Mode]

Figure 8:
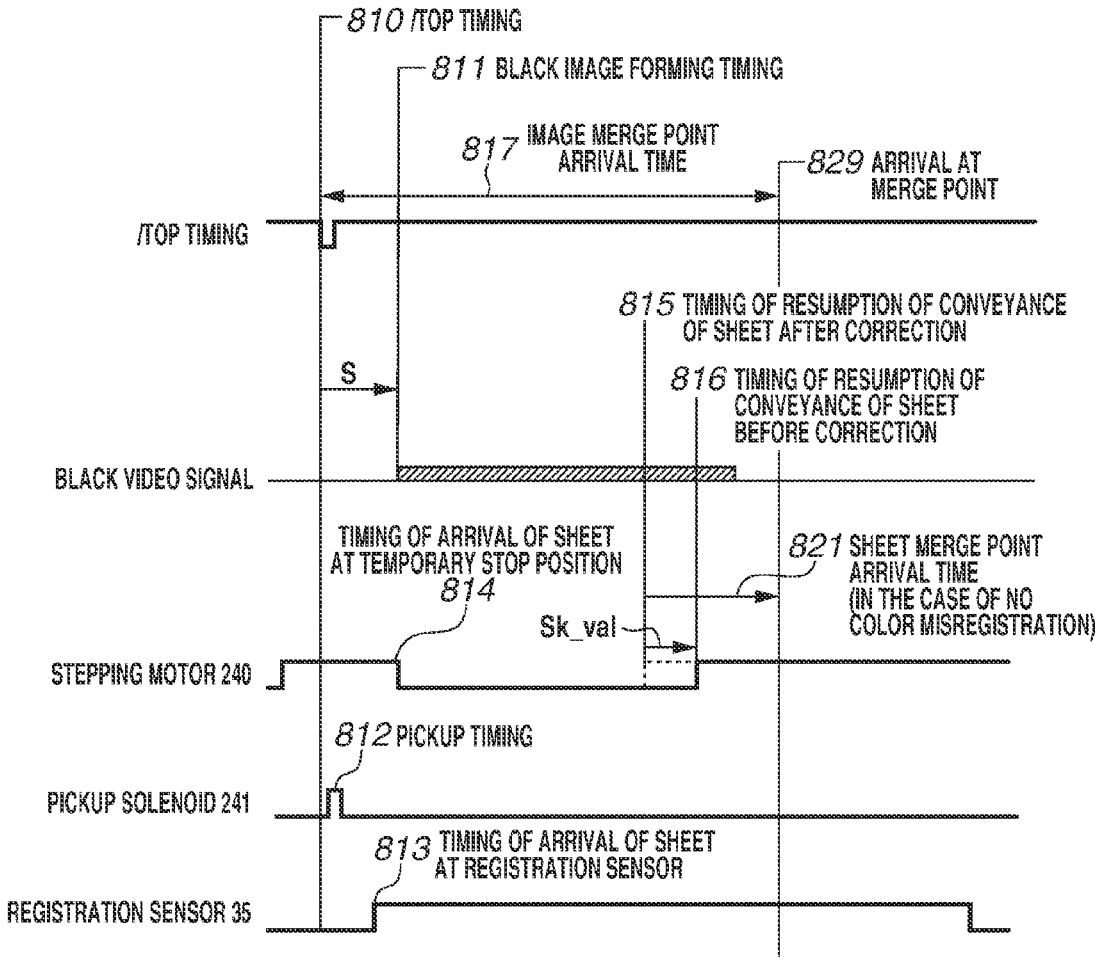
FIG. 8 is a timing chart illustrating leading edge position adjustment control when the KTOP mode is set.

FIG. 8 is a timing chart of leading edge position adjustment control in the KTOP mode. The controller 201 performs image formation of black (811) at timing at which a first predetermined time S has elapsed from when the engine control unit 202 outputs the /TOP signal (810). As with the first embodiment, the first predetermined time S is a time the length of which is the same as that in the YTOP mode.

The sheet feed and conveyance control unit 216 drives the stepping motor 240 at timing of receipt of the printing start instruction from the controller 201. After that, the sheet feed and conveyance control unit 216 drives the pickup solenoid 241 (812) to feed a sheet P placed on the cassette 16. When the leading edge of the fed sheet P is detected by the registration sensor 35 (813), the sheet feed and conveyance control unit 216 conveys the sheet P to the temporary stop position 36 and then temporarily stops conveyance of the sheet P there (814).

The engine control unit 202 performs control in such a manner that the leading edge of the sheet P and the leading edge of the toner image accord with each other at the merge point 37. An image merge point arrival time (817) from the output timing of the /TOP signal (810) until the leading edge of a toner image formed on the intermediate transfer belt 80 arrives at the merge point 37 is previously calculated from the dimensions of the associated members. Moreover, a sheet merge point arrival time (821) required to convey the sheet P from the temporary stop position 36 to the merge point 37 is previously calculated based on the length of a conveyance path and the conveyance speed of the sheet P.

The engine control unit 202 resumes conveyance of the sheet P in conformity with timing at which the leading edge of the toner image formed on the intermediate transfer belt 80 arrives at the merge point 37 (829), thus forming a toner image at an intended position on the sheet P. More specifically, the engine control unit 202 calculates the timing at which the leading edge of the toner image arrives at the merge point 37 (829) based on the image merge point arrival time (817), and resumes conveyance of the sheet P at timing (816) earlier than the calculated timing by the sheet merge point arrival time (821).

The relationship of positional deviations in the present embodiment is assumed to be the same as that described in the first embodiment with reference to FIG. 5A. In other words, when the printer 100 performs image formation in the YTOP mode and image formation in the KTOP mode, the leading edge position of an image with respect to the sheet P differs by Lk_val.

Therefore, the present embodiment corrects conveyance resumption timing of the sheet P as illustrated in FIG. 8 as a method of resolving image leading edge positional deviation occurring due to a difference between the YTOP mode and the KTOP mode. In other words, in the case of the KTOP mode, conveyance resumption timing of the sheet P is corrected by a positional deviation time of black Sk_val with respect to yellow (815).

[Flowchart of Leading Edge Position Adjustment Control in the Present Embodiment]

Figure 9:
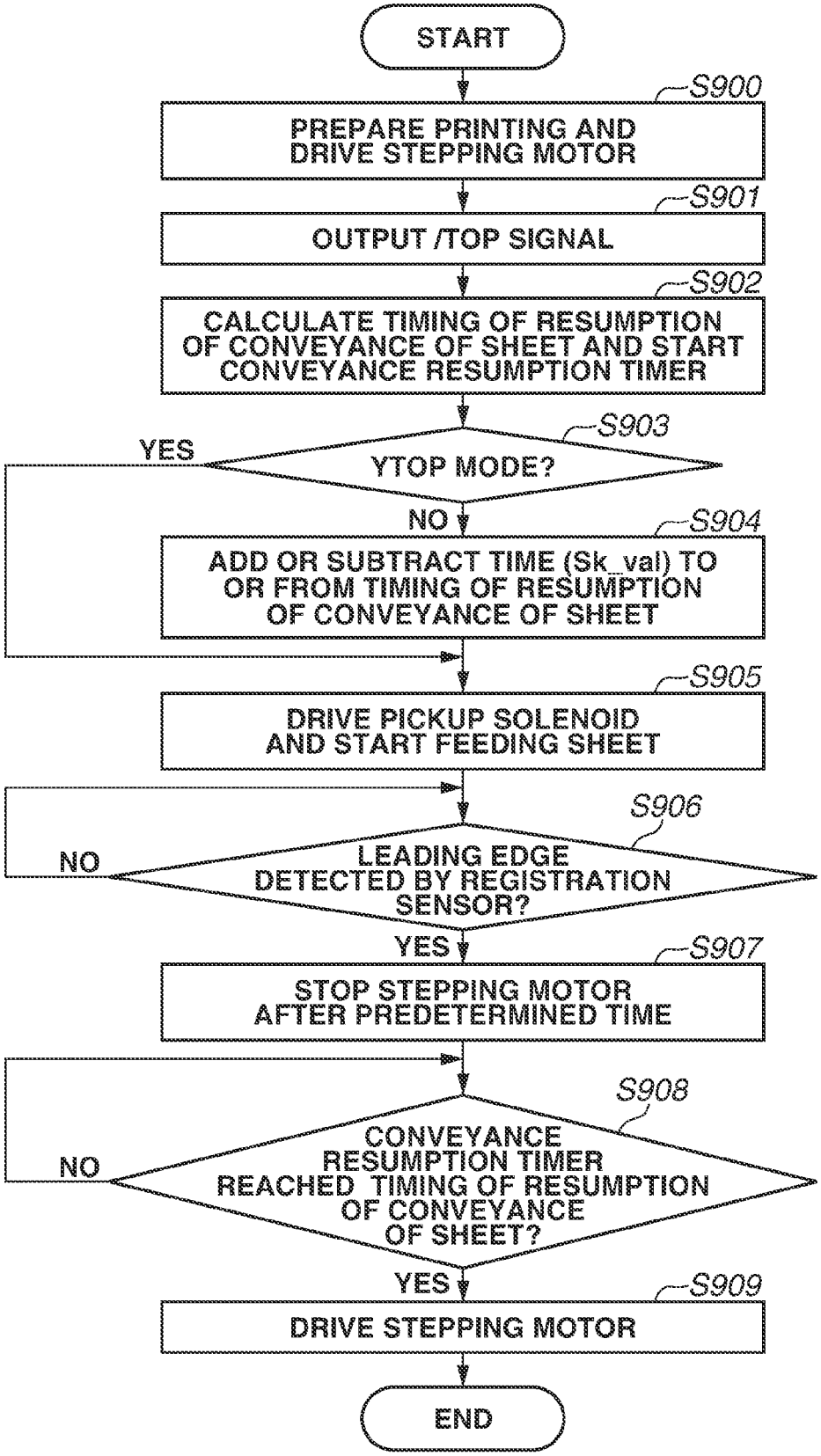
FIG. 9 is a flowchart illustrating leading edge position adjustment control in a second embodiment.

FIG. 9 is a flowchart of leading edge position adjustment control in the present embodiment. Control operations which are based on the flowchart of FIG. 9 are performed by the engine control unit 202 executing a program stored in, for example, a ROM.

First, in step S900, upon receiving a printing start instruction from the controller 201, the engine control unit 202 drives the stepping motor 240 to start preparations for printing. In step S901, when completing the preparations for printing, the engine control unit 202 outputs the /TOP signal. Then, in step S902, the engine control unit 202 calculates conveyance resumption timing of the sheet P and activates a conveyance resumption timer to start measurement of time. The conveyance resumption timing calculated here is default conveyance resumption timing, and can be obtained from the above-mentioned image merge point arrival time (817) and the sheet merge point arrival time (821). In other words, the conveyance resumption timing is set to timing at which a conveyance interval time has elapsed from the time of outputting of the /TOP signal (810). In step S903, the engine control unit 202 determines whether the printer 100 is in the YTOP mode or the KTOP mode.

When the printer 100 is in the YTOP mode (YES in step S903), the engine control unit 202 does not correct the conveyance interval. On the other hand, when the printer 100 is in the KTOP mode (NO in step S903), then in step S904, the engine control unit 202 corrects the conveyance interval time by a positional deviation time of black Sk_val, thus correcting the conveyance resumption timing. In a case where a black toner image deviates toward the downstream side in the conveyance direction of the sheet P, the engine control unit 202 makes the conveyance resumption timing late. In a case where a black toner image deviates toward the upstream side in the conveyance direction of the sheet P, the engine control unit 202 makes the conveyance resumption timing early. With this, timing at which the sheet P enters the merge point 37 is corrected.

Next, in step S905, the engine control unit 202 drives the pickup solenoid 241 to feed a sheet P placed on the cassette 16. When the leading edge of the fed sheet P is detected by the registration sensor 35 (YES in step S906), then in step S907, the engine control unit 202 continues conveyance of the sheet P for a predetermined time and, after that, stops the stepping motor 240. In step S908, the engine control unit 202 waits for the conveyance resumption timer to reach the conveyance resumption timing, and, then in step S909, drives the stepping motor 240 again, thus resuming conveyance of the sheet P. Then, the above-described control operations in the present flowchart end.

Furthermore, in the present embodiment, timing at which the sheet P arrives at the merge point 37 is adjusted by temporarily stopping the sheet P and then resuming conveyance thereof. However, the present embodiment is not limited to such a configuration. Timing at which the sheet P arrives at the merge point 37 can be adjusted by increasing or decreasing the conveyance speed of the sheet P without temporarily stopping the sheet P. In this case, instead of timing for resuming conveyance of the sheet P being adjusted, the conveyance speed of the sheet P can be adjusted according to the positional deviation time of black Sk_val.

As described above, according to the present embodiment, even in a case where a different color is used as a reference color for determining image forming timing, conveyance timing of a recording material is corrected, so that the position of an image formed on the recording material can be prevented from differing.

Furthermore, while, in the above-described embodiments, the YTOP mode, in which image forming timing is determined with yellow used as a reference, and the KTOP mode, in which image forming timing is determined with black used as a reference, have been described, the present disclosure is not limited to these modes. The present disclosure is also applicable to a control operation in a mode in which image forming timing is determined with another color, such as magenta or cyan, used as a reference.

Moreover, while, in the above-described embodiments, a positional deviation amount with respect to yellow is detected by the sensor unit 60, the present disclosure is not limited to this configuration. For example, a positional deviation amount with respect to black can be detected. In this case, image writing start timing or timing for resuming conveyance of the sheet P in the YTOP mode is corrected according to the positional deviation amount with respect to black.

Additionally, in the above-described embodiments, a configuration in which toner images are primarily transferred from the photosensitive drums 1*a* to 1*d* to the intermediate transfer belt 80 and a toner image formed on the intermediate transfer belt 80 is secondarily transferred to the sheet P is described. However, the present disclosure is not limited to such a configuration. For example, toner images can be sequentially transferred from the photosensitive drums 1*a* to 1*d* to a sheet P conveyed on the conveyance belt, and a toner image with a plurality of colors can be formed on the sheet P.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-158386 filed Aug. 12, 2016, which is hereby incorporated by reference herein in its entirety.

What is claimed is:

1. An image forming apparatus comprising:

a plurality of image bearing members;

an intermediate transfer member;

a plurality of image forming units respectively corresponding to the plurality of image bearing members and each configured to form an image on the corresponding image bearing member and to transfer the image formed on the corresponding image bearing member to the intermediate transfer member;

a conveyance unit configured to convey a recording material;

a transfer unit configured to transfer the image formed on the intermediate transfer member to the recording material conveyed by the conveyance unit;

a detection unit configured to detect image patterns for positional deviation detection respectively formed on the intermediate transfer member by the plurality of image forming units; and a control unit configured to perform control by switching between a first mode, which determines, with a first image forming unit among the plurality of image forming units used as a reference, timing of image formation performed by a second image forming unit different from the first image forming unit, and a second mode, which determines timing of image formation performed by the second image forming unit with the second image forming unit used as a reference, wherein, based on timings at which, in the first mode, the image pattern formed on the intermediate transfer member by the first image forming unit and the image pattern formed on the intermediate transfer member by the second image forming unit are respectively detected by the detection unit, the control unit, in the second mode, corrects timing of image formation performed by the second image forming unit or corrects timing at which the recording material is conveyed to the transfer unit by the conveyance unit.

2. The image forming apparatus according to claim 1, wherein, in a case where an image with a plurality of colors is formed in the first mode, the control unit causes the first image forming unit to start image formation at timing at which a first predetermined time has elapsed from when a reference signal is output, and wherein, in a case where an image with a single color is formed in the second mode, the control unit causes the second image forming unit to start image formation at timing at which the first predetermined time corrected based on a result of detection by the detection unit has elapsed from when the reference signal is output.

3. The image forming apparatus according to claim 2, wherein, in a case where an image with a plurality of colors is formed in the first mode, the control unit causes the second image forming unit to start image formation at timing at which a second predetermined time corrected based on a result of detection by the detection unit has elapsed from timing of image formation performed by the first image forming unit.

4. The image forming apparatus according to claim 1, wherein, in a case where an image with a plurality of colors is formed in the first mode, the control unit causes the first image forming unit to start image formation at timing at which a first predetermined time has elapsed from when a reference signal is output, and causes the conveyance unit to convey the recording material to the transfer unit at timing at which a conveyance interval time has elapsed from when the reference signal is output, and wherein, in a case where an image with a single color is formed in the second mode, the control unit causes the second image forming unit to start image formation at timing at which the first predetermined time has elapsed from when the reference signal is output, and causes the conveyance unit to convey the recording material to the transfer unit at timing at which the conveyance interval time corrected based on a result of detection by the detection unit has elapsed from when the reference signal is output.

5. The image forming apparatus according to claim 1, wherein each of the plurality of image forming units includes a charging portion configured to electrically charge the corresponding image bearing member, an exposure portion configured to emit light to the image bearing member electrically charged by the charging portion to form an electrostatic latent image on the image bearing member, a developing portion configured to develop the electrostatic latent image formed by the exposure portion to form a toner image on the image bearing member, and a primary transfer portion configured to transfer the toner image formed by the developing portion to the intermediate transfer member, and wherein, when the determined timing of image formation is reached, the image forming unit causes the exposure portion to start emitting light to the corresponding image bearing member.

6. The image forming apparatus according to claim 1, wherein the detection unit includes a light-emitting portion and a light-receiving portion, which receives light reflected from a surface of the intermediate transfer member or the image patterns formed on the intermediate transfer member.

7. The image forming apparatus according to claim 1, wherein the plurality of image forming units respectively corresponds to colors yellow, magenta, cyan, and black, and wherein the first image forming unit is an image forming unit corresponding to yellow, and the second image forming unit is an image forming unit corresponding to black.

8. The image forming apparatus according to claim 1, wherein the control unit obtains positional deviation amount between the image pattern formed by the first image forming unit and the image pattern formed by the second image forming unit based on the timings at which, in the first mode, the image pattern formed by the first image forming unit and the image pattern formed by the second image forming unit are respectively detected by the detection unit, and wherein the control unit, in the second mode, corrects the timing of image formation performed by the second image forming unit or corrects the timing at which the recording material is conveyed to the transfer unit by the conveyance unit based on the positional deviation amount.

9. The image forming apparatus according to claim 1, wherein the timing at which the image pattern formed by the first image forming unit is detected by the detection unit is a central timing of a timing at which a leading edge of the image pattern formed by the first image forming unit is detected by the detection unit and a timing at which a trailing edge of the image pattern formed by the first image forming unit is detected by the detection unit in a moving direction of the intermediate transfer member, and wherein the timing at which the image pattern formed by the second image forming unit is detected by the detection unit is a central timing of a timing at which a leading edge of the image pattern formed by the second image forming unit is detected by the detection unit and a timing at which a trailing edge of the image pattern formed by the second image forming unit is detected by the detection unit in the moving direction of the intermediate transfer member.

10. The image forming apparatus according to claim 1, wherein the conveyance unit temporarily stops conveying the recording material at a position in upstream side of the transfer unit in the conveyance direction of the recording material and resumes conveying the recording material based on the corrected timing at which the recording material is conveyed to the transfer unit.

11. The image forming apparatus according to claim 1, wherein the conveyance unit changes a conveyance speed of the recording material based on the corrected timing at which the recording material is conveyed to the transfer unit.

12. A method for an image forming apparatus having a plurality of image bearing members, an intermediate transfer member, and a plurality of image forming units respectively corresponding to the plurality of image bearing members and each configured to form an image on the corresponding image bearing member and to transfer the image formed on the corresponding image bearing member to the intermediate transfer member, the method comprising:

conveying a recording material;

transferring, via a transfer unit, the image formed on the intermediate transfer member to the conveyed recording material;

detecting image patterns for positional deviation detection respectively formed on the intermediate transfer member by the plurality of image forming units; and performing control by switching between a first mode, which determines, with a first image forming unit among the plurality of image forming units used as a reference, timing of image formation performed by a second image forming unit different from the first image forming unit, and a second mode, which determines timing of image formation performed by the second image forming unit with the second image forming unit used as a reference, wherein, based on timings at which, in the first mode, the image pattern formed on the intermediate transfer member by the first image forming unit and the image pattern formed on the intermediate transfer member by the second image forming unit are respectively detected, performing control, in the second mode, includes correcting timing of image formation performed by the second image forming unit or correcting timing at which the recording material is conveyed to the transfer unit.

13. The method according to claim 12, wherein, in a case where an image with a plurality of colors is formed in the first mode, performing control includes causing the first image forming unit to start image formation at timing at which a first predetermined time has elapsed from when a reference signal is output, and wherein, in a case where an image with a single color is formed in the second mode, performing control includes causing the second image forming unit to start image formation at timing at which the first predetermined time corrected based on a result of detection has elapsed from when the reference signal is output.

14. The method according to claim 13, wherein, in a case where an image with a plurality of colors is formed in the first mode, performing control includes causing the second image forming unit to start image formation at timing at which a second predetermined time corrected based on a result of detection has elapsed from timing of image formation performed by the first image forming unit.

15. The method according to claim 12, wherein, in a case where an image with a plurality of colors is formed in the first mode, performing control includes causing the first image forming unit to start image formation at timing at which a first predetermined time has elapsed from when a reference signal is output, and causing conveying the recording material to the transfer unit at timing at which a conveyance interval time has elapsed from when the reference signal is output, and wherein, in a case where an image with a single color is formed in the second mode, performing control includes causing the second image forming unit to start image formation at timing at which the first predetermined time has elapsed from when the reference signal is output, and causing conveying the recording material to the transfer unit at timing at which the conveyance interval time corrected based on a result of detection has elapsed from when the reference signal is output.

16. The method according to claim 12, wherein each of the plurality of image forming units includes a charging portion configured to electrically charge the corresponding image bearing member, an exposure portion configured to emit light to the image bearing member electrically charged by the charging portion to form an electrostatic latent image on the image bearing member, a developing portion configured to develop the electrostatic latent image formed by the exposure portion to form a toner image on the image bearing member, and a primary transfer portion configured to transfer the toner image formed by the developing portion to the intermediate transfer member, and wherein, when the determined timing of image formation is reached, the image forming unit causes the exposure portion to start emitting light to the corresponding image bearing member.

17. The method according to claim 12, wherein detecting is via a detection unit having a light-emitting portion and a light-receiving portion, which receives light reflected from a surface of the intermediate transfer member or the image patterns formed on the intermediate transfer member.

18. The method according to claim 12, wherein the plurality of image forming units respectively corresponds to colors yellow, magenta, cyan, and black, and wherein the first image forming unit is an image forming unit corresponding to yellow, and the second image forming unit is an image forming unit corresponding to black.

19. A non-transitory computer-readable storage medium storing a program to cause an image forming apparatus to perform a method, wherein the image forming apparatus includes a plurality of image bearing members, an intermediate transfer member, and a plurality of image forming units respectively corresponding to the plurality of image bearing members and each configured to form an image on the corresponding image bearing member and to transfer the image formed on the corresponding image bearing member to the intermediate transfer member, the method comprising:

conveying a recording material;

transferring, via a transfer unit, the image formed on the intermediate transfer member to the conveyed recording material;

detecting image patterns for positional deviation detection respectively formed on the intermediate transfer member by the plurality of image forming units; and performing control by switching between a first mode, which determines, with a first image forming unit among the plurality of image forming units used as a reference, timing of image formation performed by a second image forming unit different from the first image forming unit, and a second mode, which determines timing of image formation performed by the second image forming unit with the second image forming unit used as a reference, wherein, based on timings at which, in the first mode, the image pattern formed on the intermediate transfer member by the first image forming unit and the image pattern formed on the intermediate transfer member by the second image forming unit are respectively detected, performing control, in the second mode, includes correcting timing of image formation performed by the second image forming unit or correcting timing at which the recording material is conveyed to the transfer unit.

* * * * *